US006473975B1

(12) United States Patent
Sellmann

(10) Patent No.: US 6,473,975 B1
(45) **Date of Patent: *Nov. 5, 2002**

(54) POWER CHAIN SAW WITH A SAW GUIDE MAINTAINED CLAMPED BETWEEN THE HOUSING AND A TIGHTENING ELEMENT

(75) Inventor: Dieter Sellmann, Hamburg (DE)

(73) Assignee: Dolmar GmbH, Hamburg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/141,730

(22) Filed: Aug. 27, 1998

(30) Foreign Application Priority Data

Aug. 29, 1997 (DE) ..... 197 37 886

(51) Int. Cl.[7] ..... B27B 27/00
(52) U.S. Cl. ..... 30/386; 83/816
(58) Field of Search ..... 30/383, 384, 385, 30/386, 387; 403/105, 104, 110

(56) References Cited

U.S. PATENT DOCUMENTS

| | | | | | |
|---|---|---|---|---|---|
| 3,636,995 | A | * | 1/1972 | Newman | 30/386 |
| 4,117,594 | A | | 10/1978 | Arbuckle | 30/381 |
| 4,563,817 | A | * | 1/1986 | Leighton | 30/386 |
| 4,920,650 | A | * | 5/1990 | Edlund | 30/386 |
| 4,939,842 | A | * | 7/1990 | Rebhan | 30/386 |
| 4,999,918 | A | | 3/1991 | Schliemann | |
| 5,070,618 | A | * | 12/1991 | Edlund | |
| 5,144,751 | A | * | 9/1992 | Weber | |
| 5,491,899 | A | * | 2/1996 | Schliemann et al. | 30/386 |
| 5,653,028 | A | | 8/1997 | Hashimoto | 30/123 |

FOREIGN PATENT DOCUMENTS

| | | | | |
|---|---|---|---|---|
| DE | 3843459 A1 | | 6/1990 | |
| SU | 1329966 | * | 8/1987 | 30/386 |

* cited by examiner

*Primary Examiner*—Kenneth E. Peterson
(74) *Attorney, Agent, or Firm*—Pillsbury Winthrop LLP

(57) ABSTRACT

A power chain saw with a drive motor arranged in a housing drives a saw chain circulating on a saw guide, wherein the saw guide is held clamped by one end transversely to its surface plane between the housing and a tightening element, and for tightening the saw chain can be displaced in the longitudinal direction L when the tightening element is detached. The power chain saw also includes detent plates arranged between the saw guide and the housing and/or between the saw guide and the tightening element, which permit the displacement of the saw guide in the tightening direction, but block it in the loosening direction of the chain. The tightening element can be embodied as chain wheel protector.

2 Claims, 1 Drawing Sheet

POWER CHAIN SAW WITH A SAW GUIDE MAINTAINED CLAMPED BETWEEN THE HOUSING AND A TIGHTENING ELEMENT

BACKGROUND OF THE INVENTION

1. Field of the Invention

The invention relates to a power chain saw with a drive motor arranged in a housing, which drives a saw chain circulating on a saw guide, wherein the saw guide is held clamped by one end transversely to its surface plane between the housing and a tightening element.

2. Description of the Related Art

A power chain saw of the species is known from DE 38 43 459 A1, for example. A power chain saw is described in this document, wherein a drive motor arranged in a housing drives, by means of a chain wheel, a saw chain circulating on a saw guide. On its one end the saw guide is held clamped on the housing transversely to its surface plane between the housing and a tightening element. When the tightening element is detached, for tightening the saw chain the saw guide can be adjusted in the longitudinal direction by means of a chain tightening device. The chain tightening device is adjusted by means of an actuating screw, wherein a bolt engages the saw guide and is displaced along a slit in the crank housing. Following the completed adjustment of the chain tension, the tightening device is tightened, and the saw guide is clamped between the housing and the tightening element in the process. The facing surfaces between the end of the saw guide and the housing, or respectively the tightening element have been treated to increase their coefficients of friction, so that greater forces can act on the clamping without causing a displacement of the saw guide.

The disadvantage of this known technology is that, in spite of the treatment of the facing surfaces for increasing the coefficient of friction, a displacement of the saw guide in its longitudinal direction toward the housing is possible during operation. In connection with hard work in particular, when the chain is under a great load and the friction clutch between the motor and the chain, which is customarily provided, is partially released, practically all of the force which can be maximally attained prior to the release of the friction clutch acts in the longitudinal direction on the saw guide. Therefore frequent re-tightening of the chain is required. Another disadvantage is the tightening process itself. A relatively elaborate mechanism is required for clamping the saw guide with the required force in the longitudinal direction. In connection with devices for leisure time use in particular, it is necessary to principally avoid elaborate and therefore expensive solutions. But the force which can be manually exerted without assistance is insufficient for sufficiently tightening a saw chain. An opening provided in the saw guide, through which a lever is pushed, which can be supported on the housing, is also no sufficient, since such a tightening device could not be operated by one person alone, since it is necessary to simultaneously perform clamping and the tightening of the tightening device.

BRIEF SUMMARY OF THE INVENTION

It is the object of the invention to present a power saw with a tightening device for the saw chain, which makes the simple adjustment of the chain tension by a single person possible, which moreover can be advantageously produced and which makes the regular re-tightening of the chain during operation unnecessary, even under greater stress.

The object is attained by a power chain saw having the characteristics of claim 1.

The power chain saw of the invention includes a housing, in which the drive motor is arranged. The drive motor drives a saw chain circulating on the saw guide. On its end facing the motor, the saw guide is held clamped transversely to its surface plane between the housing and a tightening element. With the tightening element detached, the saw guide can be displaced in the longitudinal direction for tightening the saw chain. The saw guide rests with one side against the housing and with the other side against the tightening element. Blocking means are arranged between the saw guide and the housing and/or the saw guide and the tightening element, which permit the displacement of the saw guide only in the longitudinal direction away from the housing, i.e. for tightening the chain, when the tightening element is detached. No displacement toward the housing is possible. The blocking means block the displacement in this direction.

Detent plates are preferably used as blocking means, which for example can be arranged between the saw guide and the tightening element. One detent plate is fixedly connected with the saw guide and is in contact with a correspondingly embodied detent plate fastened on the tightening element. The teeth of the detent plate are arranged in a sawtooth pattern in such a way that a displacement is only possible in the tightening direction of the chain. A displacement in the other direction is only possible after the almost complete detachment of the tightening element, so that the teeth of the correspondingly designed detent plates can no longer come into contact with each other.

The tightening element is preferably designed as a chain wheel protector.

In a preferred further development of the invention, an elastic element is arranged between the housing and the saw rail and/or the tightening element and the saw rail which, when the tightening element is detached, maintains the saw guide and the blocking element against each other with elastic prestress. The chain guide plate, for example, can function as such an elastic element. If the tightening element is slightly loosened, the elastic force of the elastic element acts in such a way that the saw guide is pushed against the oppositely located part of the power saw, i.e. either against the housing or against the tightening element. The blocking means, which are maintained in contact by the elastic force, are on the side located opposite the elastic element.

The invention will be explained in greater detail in what follows by means of the attached drawings.

DETAILED DESCRIPTION OF THE INVENTION

Figure 1:
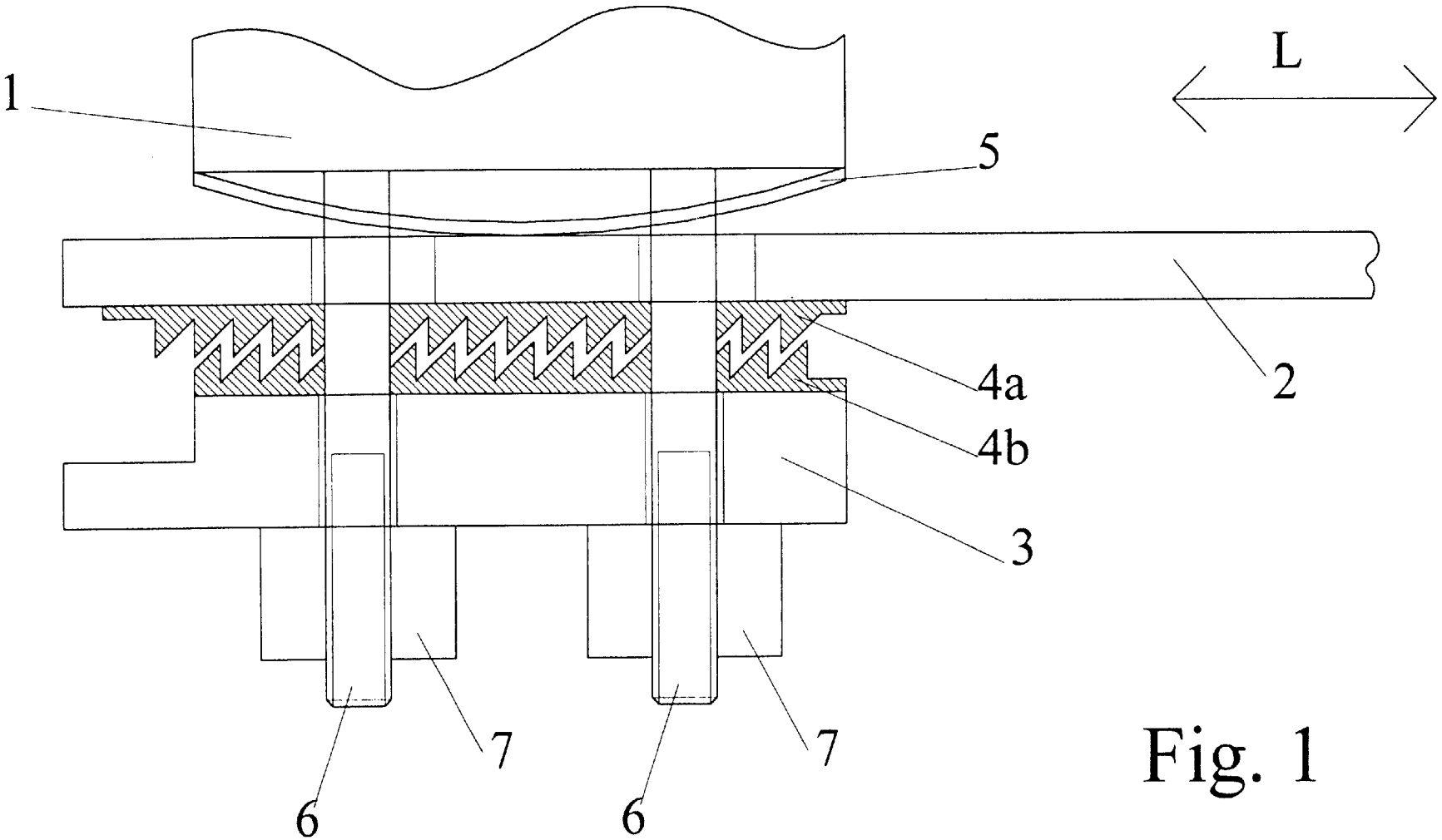
FIG. 1 represents a tightening device of the saw guide of a power saw in a partially cut view from above.

A section of the motor housing 1 can be seen in FIG. 1. Two bolts 6 project out of the motor housing 1, on which the saw guide 2 can be placed by means of two elongated holes. The elongated holes are arranged in such a way that a displacement of the saw guide in the longitudinal direction L is possible. The saw guide is clamped between the housing 1 and the tightening element 3 by means of the tightening element 3, which can be clamped against the housing by the two nuts 7.

Detent plates 4*a* and 4*b*, which are correspondingly embodied and have a sawtooth-like form, are arranged between the saw guide 2 and the tightening element 3. The detent plate 4*a* is fixedly connected with the saw guide 2, while the detent plate 4*b* is fixedly connected with the tightening element 3 or is held in a fixed position in respect to the tightening element by two bolts 6. The saw guide 2 can be displaced in the longitudinal direction L, wherein the detent plates act in such a way that only a displacement away from the housing, i.e. to the right in the drawing, is possible, while the displacement in the opposite direction is prevented by the teeth of the detent plates 4*a*; 4*b*.

The chain guide plate 5, which is elastic, is arranged between the housing 1 in the saw guide 2. For tightening the saw chain it is only necessary to slightly loosen the two nuts 7, while the chain guide plate 5 exerts an elastic prestress on the saw guide 2 in the process, so that the two detent plates 4*a* and 4*b* remain in contact in spite of the detached tightening element 3. It is now possible to displace the saw guide 2 to the right, while in the process it is always slightly lifted against the chain guide plate 5 by the detents and is pushed into the next detent by the chain guide plate. A movement to the left is not possible. For this, the two nuts 7 would have to be loosened until the chain guide plate 5 could no longer exert an elastic force on the saw blade 2, and the detent plates 4*a* and 4*b* are no longer in contact.

The advantage of this embodiment is that a lever can be pushed through a simple opening in the saw guide, which can be supported on a place on the housing provided for this. By means of this it is possible to clamp the saw guide 2 by the lever force alone. The detent plates 4*a* and 4*b* catch in the desired position. The lever can be removed and the nuts 7 can be tightened. The tightening element 3 clamps the saw guide 2 between the housing 1 and the tightening element 3. The saw guide cannot slide back. One person can easily manipulate this clamping device. During operation of the power saw, the saw guide 2 cannot slide back in the direction toward the housing even under extreme loads. The chain maintains the once set tension indefinitely.

What is claimed is:

1. A chain saw, comprising:

a housing;

a drive motor attached to the housing, the drive motor including a driveshaft;

a chain guide adapted for movement transverse to the drive shaft;

a saw chain adapted to be driven by the driveshaft for circulation around the chain guide, the transverse movement of the chain guide in a first direction tightening the chain with respect to the chain guide and driveshaft, the transverse movement of the chain guide in a second direction loosening the chain with respect to the chain guide and driveshaft;

a chain guide tightener adapted for selectively clamping the chain guide to the housing to prevent the transverse movement of the chain guide and unclamping the chain guide from the housing to allow the transverse movement of the chain guide; and a blocking mechanism disposed between the housing and the chain guide tightener, wherein the blocking mechanism includes a pair of detent plates adapted for selectively engaging each other to permit the movement of the chain guide in the first direction and prevent movement of the chain guide in the second direction;

wherein each detent plate includes saw tooth projections and respective projections of each detent plate can be brought into engagement with each other to interlock the detent plates, the detent plate and the saw tooth projections being integrally formed; and wherein, when the chain guide tightener is selected for unclamping the chain guide, the blocking mechanism permits the movement of the chain guide in the first direction and prevents movement of the chain guide in the second direction and when moving the chain guide in the first direction the chain guide is lifted against the chain guide tightener and chain guide plate having an elastic preload between the housing and the chain guide tightener exerts an elastic prestress on the chain guide and the detent plates when the chain guide tightener is selected for unclamping the chain guide.

2. A chain saw, comprising:

a housing;

a drive motor attached to the housing, the drive motor including a driveshaft;

a chain guide adapted for movement transverse to the driveshaft;

a saw chain adapted to be driven by the driveshaft for circulation around the chain guide, the transverse movement of the chain guide in a first direction tightening the chain with respect to the chain guide and driveshaft, the transverse movement of the chain guide in a second direction loosening the chain with respect to the chain guide and driveshaft;

a chain guide tightener adapted for selectively clamping the chain guide to the housing to prevent the transverse movement of the chain guide and unclamping the chain guide from the housing to allow the transverse movement of the chain guide, wherein the chain guide tightener is a chain wheel protector of the chain saw; and a blocking mechanism disposed between the housing and the chain guide tightener;

wherein, when the chain guide tightener is selected for unclamping the chain guide, the blocking mechanism permits the movement of the chain guide in the first direction and prevents movement of the chain guide in the second direction; and wherein the blocking mechanism includes a pair of detent plates and each detent plate includes saw tooth projections and respective projections of each detent plate can be brought into engagement with each other to interlock the detent plates and when moving the chain guide in the first direction the chain guide is lifted against the chain guide tightener, the detent plate and the saw tooth projections being integrally formed, and a chain guide plate having an elastic preload between the housing and the chain guide tightener exerts an elastic prestress on the chain guide and the detent plates when the chain guide tightener is selected for unclamping the chain guide.

* * * * *